United States Patent [19]

Sanders, Jr. et al.

[11] Patent Number: 4,948,280

[45] Date of Patent: Aug. 14, 1990

[54] SERIAL PRINTER CARRIAGE DRIVE WITH BALLISTIC REBOUND REVERSAL

[75] Inventors: Royden C. Sanders, Jr., R.R. #2, Wilton, N.H. 03086; John L. Forsyth, So. Lyndeborough, N.H.; John P. Conant, Milford, N.H.

[73] Assignee: Royden C. Sanders, Jr., Wilton, N.H.

[21] Appl. No.: 336,840

[22] Filed: Apr. 12, 1989

[51] Int. Cl.[5] ..... B41J 19/30

[52] U.S. Cl. ..... 400/323; 400/341

[58] Field of Search ..... 310/36, 37; 400/320, 400/322, 323, 328, 341; 74/37

[56] References Cited

U.S. PATENT DOCUMENTS

| | | | |
|---|---|---|---|
| 2,092,585 | 9/1937 | Mulhare | 400/341 |
| 2,846,623 | 8/1958 | Wolff | 317/180 |
| 3,001,092 | 9/1961 | Nemeth | 310/37 |
| 3,313,387 | 4/1967 | Lenney | 400/341 |
| 3,694,782 | 9/1972 | Ray | 335/230 |
| 3,952,217 | 4/1976 | Rawlings | 310/36 |
| 4,084,681 | 4/1981 | Heinzl | 400/320 X |
| 4,219,825 | 8/1980 | Heyraud et al. | 310/36 X |
| 4,359,289 | 11/1982 | Barrus | 400/322 |
| 4,445,798 | 5/1984 | Munehiro | 400/322 X |
| 4,507,634 | 3/1985 | Vanderlaan | 310/36 X |

FOREIGN PATENT DOCUMENTS

| | | | |
|---|---|---|---|
| 142128 | 6/1980 | German Democratic Rep. | 400/341 |

*Primary Examiner*—David A. Wiecking

*Attorney, Agent, or Firm*—Davis, Bujold & Streck

[57] ABSTRACT

In a serial printer wherein a bi-directionally operating motor with a shaft drives a carriage in an oscillatory motion between two end points, an improvement for minimizing the time for direction reversal of the carriage. There is a ballistic rebound device for transferring energy of the moving motor and carriage in one direction into a resilient member and for retransmitting energy absorbed by the resilient member back into the motor and carriage in a direction opposite the one direction. There is also an electrically operated clutch for selectively coupling the ballistic rebound device to the shaft of the motor. Sensing apparatus is provided for sensing the position of the carriage with respect to the two ends. Finally, logic connected to the sensing device is provided for removing a drive voltage from the motor and connecting the ballistic rebound device to the motor shaft at points with respect to the end points which will cause the carriage to stop motion in one direction at a desired position with respect to the end points and for applying a drive voltage to the motor and disconnecting the ballistic rebound device from the motor shaft at points with respect to the end points which will cause the carriage to stop and accelerate to a maximum velocity in a direction opposite the one direction in a minimum amount of time.

28 Claims, 4 Drawing Sheets

SERIAL PRINTER CARRIAGE DRIVE WITH BALLISTIC REBOUND REVERSAL

BACKGROUND OF THE INVENTION:

This invention relates to dot matrix printers of the serial variety and, more particularly, in a serial printer wherein a bi-directionally operating motor with a shaft drives a carriage in an oscillatory motion between variable end points, to the improvement for minimizing the time for direction reversal of the carriage comprising, ballistic rebound means for transferring energy of the moving motor and carriage in one direction into a resilient member and for retransmitting energy absorbed by the resilient member back into the motor and carriage in a direction opposite the one direction; electrically operated clutch means for selectively coupling the ballistic rebound means to the shaft of the motor, the electrically operated clutch being concentrically attached to the shaft of the motor on an input side of the clutch and the ballistic rebound means being connected to the clutch on an output side of the clutch; sensing means for sensing the position of the carriage with respect to the two ends; and, logic means connected to the sensing means for removing a drive voltage from the motor and connecting the ballistic rebound means to the motor shaft at points with respect to the end points which will cause the carriage to stop motion in one direction at a desired position with respect to the end points and for applying a drive voltage to the motor and disconnecting the ballistic rebound means from the motor shaft at points with respect to the end points which will cause the carriage to stop and accelerate to a maximum velocity in a direction opposite the one direction in a minimum amount of time.

Dot matrix types of printers have been and continue to be very popular for use with computers. They are generally quite fast in operation and less costly than other types of printers operating at comparable speeds. Recently, the dot matrix printer art has undergone a technological leap forward in performance by the introduction of ballistic shuttle type dot matrix printers. As shown in simplified form in FIG. 1, a shuttle printer 10 incorporates a moving carriage 12 containing multiple print heads (not shown for simplicity) which is driven back and forth (i.e. shuttled) between the ends of movement on rails 14 by a linear motor generally indicated as 16. This approach was introduced by the inventor herein to supercede earlier driving arrangements wherein a bellcrank driven by a conventional motor was used to drive the carriage 12 in its oscillatory motion. The bellcrank drives simply could not reverse the direction of movement of the carriage 12 fast enough. As a result, printer throughput was greatly limited. By employing the linear motor 16 and having the carriage 12 strike a resilient member 18 (e.g. a spring or elastomeric block) the inventor herein found that the reversal time of the carriage 12 could be greatly improved to less than 1 millisecond with an attendant increase in printer throughput.

A shuttle printer or line printer is characterized by always being able to print a complete line regardless of the actual line that needs to be printed. It saves no time if the line that is being printed is short. Shuttle printers are usually one row of horizontal actuators evenly spaced which print one dot line at a time. Shuttle printers need fast turnaround at the end of the horizontal carriage motion but it is always at a fixed point and so the device shown in FIG. 1 is quite adequate to give very fast turnaround times.

A serial printer is a printer having n pins spaced vertically or in a pattern which is small compared to total print line length, but which can and does shorten the carriage motion to adapt to the length of the print line actually being printed at a given instant. This type of printer needs a fast turnaround although not usually as fast as the shuttle printer. It is different from the shuttle printer in that the turnaround point can be different on every line. Obtaining fast turnarounds at variable points horizontally is an objective of this invention.

Current serial printers have serious loss of throughput due to excessively long turnaround times. Unlike shuttle printers, the carriage must reverse anyplace along its length. The average letter has an average line width of about 4.5 inches and the maximum print line is usually 8 or 13.2 inches.

In current printers the time taken for the carriage to slow, stop, reverse, and reach traverse speed is over 100 milliseconds with a typical time being 150 milliseconds. With the new higher speed printheads coming into use, the speed of traverse has been increased to at least 33 inches per second (ips) and may be as high as 46.7 ips. At 46.7 ips, an eight inch traverse by the carriage will take 171 milliseconds. As can be immediately appreciated, a turnaround time of 150 milliseconds substantially reduces the effective printing speed of the printer.

What is desired is a means of reducing the turnaround time to about 20 milliseconds in an economically priced system. It is generally agreed that reducing the turnaround time below that to any great extent in a serial printer will not materially affect the effective printing speed of the printer and may add significantly to the cost.

In today's serial printers, the carriage motor size and cost is determined by this reversal speed and about the best it can do is turnaround times of about 90 milliseconds and settling times of 60 milliseconds.

Wherefore, it is the principal object of the present invention to provide a method and apparatus for use in the driving of the carriage in a serial printer which can affect turnaround of the carriage in 20 milliseconds in a manner which is economical to produce on a commercial basis.

Other objects and benefits of this invention will become apparent from the detailed description which follows hereinafter when taken in conjunction with the drawing figures which accompany it.

SUMMARY

The foregoing object has been achieved in a serial printer wherein a bi-directional motor drive drives a carriage in an oscillatory motion between two variable end points by the improvement of the present invention for minimizing the time for direction reversal of the carriage comprising, ballistic rebound means for transferring energy of the moving carriage in one direction into a resilient member and for retransmitting energy absorbed by the resilient member back into the moving carriage in a direction opposite the one direction and releasable coupling means for selectively coupling the ballistic rebound means to the motor drive adjacent the end points.

In the preferred embodiment, the releasable coupling means comprises an electrically operated clutch. Typically, the motor drive includes a motor with a rotating shaft, the electrically operated clutch is attached to the shaft of the motor, and the ballistic rebound means is connected to the shaft of the motor through the clutch.

The electrically operated clutch may include a ferromagnetic ring concentrically attached to the shaft of the motor through a spring spider and an electromagnet concentrically connected to the ballistic rebound means, the electromagnet including a coil and pole pieces disposed adjacent the ring whereby the ring is attracted and gripped to couple the ring to the electromagnet when a voltage is applied to the coil.

The ballistic rebound means may comprise an input shaft mounted for bi-directional rotation and torsion creating means connected to the input shaft for creating an opposing bias force opposite rotation of the input shaft. In one version, the torsion creating means comprises a pair of torsion springs mounted to resist rotation of the input shaft in respective ones of two opposite directions. In another version, it comprises an elastomeric member connected on a first end to the input shaft and held against rotation on a second end opposite the first end.

In one embodiment, the torsion creating means comprises a cylindrical elastomeric member concentrically connected around the input shaft; and, the electrically operated clutch comprises brake means concentrically disposed about the cylindrical elastomeric member for selectively gripping the cylindrical elastomeric member to prevent rotation thereof and brake activation means operatively connected for operating the brake means, the brake activation means including a coil disposed to compress the brake means about the elastomeric member whereby the elastomeric member is gripped and held against rotation when a voltage is applied to the coil.

In the preferred embodiment the motor drive includes a bi-directionally rotating electric motor and there is also sensing means for sensing the position of the carriage with respect to the two ends and logic means connected to the sensing means for removing a drive voltage from the motor and connecting the ballistic rebound means to the motor drive at points with respect to the end points which will cause the carriage to stop motion in one direction at a desired position with respect to the end points and for applying a drive voltage to the motor and disconnecting the ballistic rebound means from the motor drive at points with respect to the end points which will cause the carriage to stop and accelerate to a maximum velocity in a direction opposite the one direction in a minimum amount of time.

Figure 1:
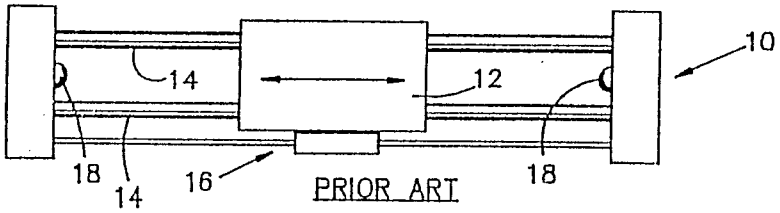
PRIOR ART FIG. 1
FIG. 1 is a simplified drawing of a shuttle dot matrix printer showing the prior art technique of rebounding the carriage against a resilient stop at each end of its travel.

DESCRIPTION OF THE PREFERRED EMBODIMENT:

The prior art approach of FIG. 1 shows a successful method of reversing the carriage in 1 or 2 milliseconds as applied to shuttle printer. The carriage 12 is moved horizontally at a linear speed along the carriage rails 14 by the linear motor 16 until it meets the rubber bumper 18 at which times the velocity of the carriage is reversed with about 80 % or more energy efficiency and at 90 % or more of its impact velocity in 1 to 3 milliseconds. Means, not shown, are used to isolate the rebound force from the main section of the printer.

This is an excellent method for a shuttle printer but is not applicable for serial printers for the following reasons.

1. The carriage can only be reversed at the end of a full stroke and so would be very inefficient for the short strokes commonly used by a serial printer.
2. Shuttle printers commonly use strokes under 1 inch of travel where a linear motor is relatively efficient. Linear motors would get very big and inefficient with strokes of 8" to 13.2".

Figure 2:
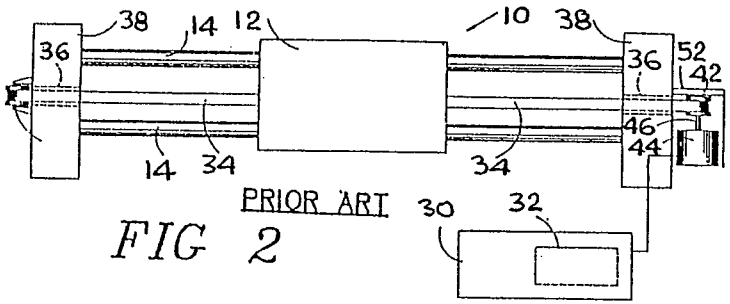
PRIOR ART FIG. 2
FIG. 2, is a simplified plan view drawing of a serial dot matrix printer showing the prior art showing the technique of reversing the carriage by means of the carriage motor.

FIG. 2 illustrates one of the present methods of reversing the carriage in serial printers. The carriage 12 is moved back and forth on rails 14 by the carriage motor 44 through the pulley 42 and the timing belt 34. The motor 44 must supply all the power needed to reverse its own rotor inertia as well as inertia of the carriage 12. The power taken to reverse the carriage even as slow as 90 to 100 milliseconds is many times that needed to keep the carriage at constant speed while printing. In addition, a stabilization is required for the carriage to reach printing speed because of the lack of a horizontal position sensing apparatus shown in FIG. 3.

As is well known, an electrical brake can be applied almost instantaneously (i.e., 2 to 3 milliseconds). Thus, if an electrical brake can be employed in the manner of a clutch to connect a highly efficient and sturdy rebound device to the drive mechanism of the carriage 12 in a serial printer 10, the reversal can be accomplished exactly at the desired time in the movement of the carriage and, further, it can be accomplished repeatedly in the minimal time duration desired without damage to undersized parts. This is exactly the approach taken by this invention.

Figure 3:
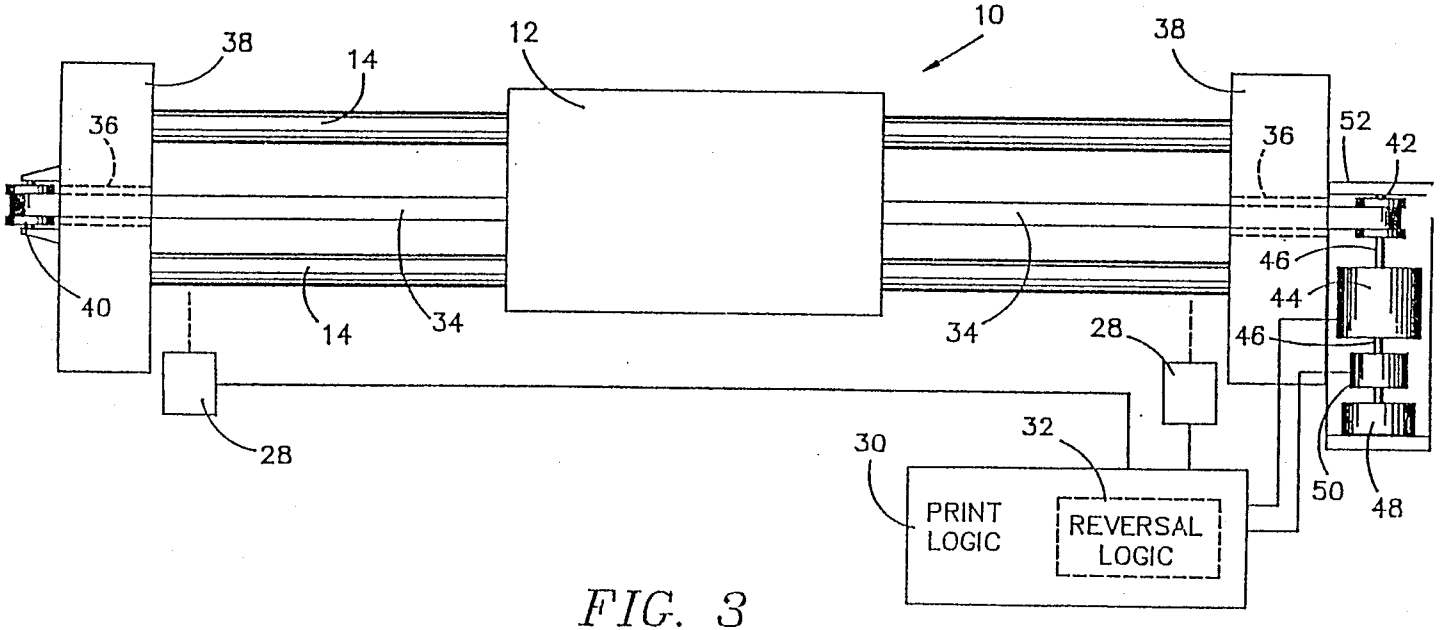
FIG. 3 is a simplified plan view drawing of a serial dot matrix printer according to the present invention showing the technique of rebounding the carriage by means of a rebounding mechanism releasably connectable to a motor drive driving the carriage through a non-stretching belt attached thereto.
Figure 4:
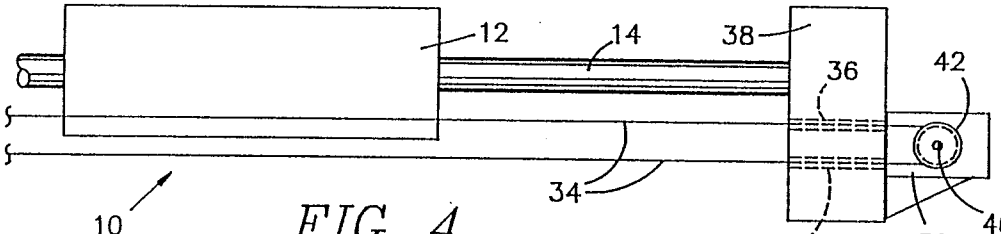
FIG. 4 is a partial front view of the apparatus of FIG. 3.

As shown in FIG. 3, a serial printer 10 operating according to the present invention again includes a carriage 12 moving back and forth on rails 14. As in the preferred prior approaches, there is some sort of optical position sensing apparatus 28 employed for providing continuous information on the position of the carriage 12 to the print logic 30. For the present invention, the print logic 30 additionally includes reversal logic 32 receiving control signals dependent on the positional signals from the position sensing apparatus 28. In other words, the reversal logic 32 can make its own reversal decisions based on direct positional inputs from the apparatus 28 or can respond to reversal commands from the print logic 30 based on positional inputs from the apparatus 28. The exact manner of accomplishing the reversal logic 32 associated with the present invention is not a critical aspect thereof and can be according to convenience in the particular implementation thereof.

The carriage is driven by a belt 34 of a relatively nonstretching material as generally available in the art. The belt 34 is in the form of a loop which is attached to the carriage 12 at one point. The belt 34 passes through slots 36 in the frame 38 of the printer 10 as necessary and, additionally, is supported for rotation on one end by an idler pulley 40 and on the other end by a drive pulley 42. The drive pulley 42, in turn, is driven bidirectionally by a motor 44. The shaft 46 of the motor 44 on the side opposite the drive pulley 42 is connected to a rebound device 48 through an electrically operated clutch 50. The motor 44 and clutch 50 are electrically connected to the print logic 30 and reversal logic 32 to be controlled thereby. The motor 44, clutch 50 and rebound device 48 are mounted to a common support member 52 which is mounted to the frame 38 of the printer 10 with the belt 34 in proper parallel alignment with the rails 14 to affect optimum drive forces to the carriage 12. Thus, the carriage 12 is driven in one direction by the motor 44 through belt 34 with the rebound device 48 disconnected from the shaft 46 by the clutch 50. At the proper point of reversal, the logic 30, 32 sends a signal to the clutch 50 causing it to connect the rebound device 48 to the shaft 46. Virtually instantaneously, the rebound device 48 absorbs the ballistic energy of the carriage 12 and retransmits it back to the carriage 12 in the opposite direction to affect the desired 20 millisecond reversal. When the direction has been reversed and before the rebound device 48 can impart an undesired counter force, it is disconnected by the clutch 50 under the control of the logic 30, 32.

The carriage 12 has a mass M12 and the timing belt 34 has a compliance S34. Together M12 and S34 are resonant at fc although this resonance is highly damped due to the friction between the carriage 12 and the carriage rods 14. Nevertheless, it is important that 1/fc be less than one third of the turnaround time of the motor mass and that this dynamic action be accounted for in the total turnaround time.

Figure 5:
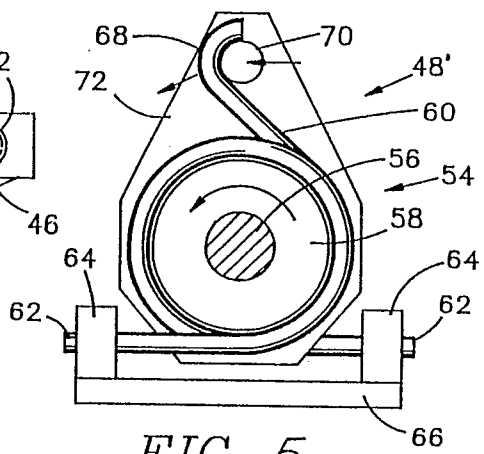
FIG. 5 is an end view of a one of two alternate preferred configurations for a rebounding device for use in the present invention.
Figure 6:
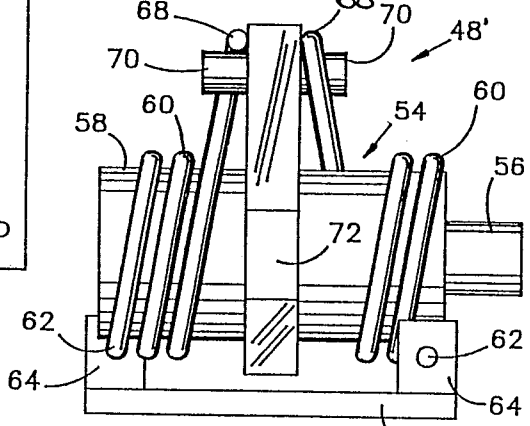
FIG. 6 is a side view of the device of FIG. 5.

The rebound device 48 can take several forms to attain the objects of the invention successfully. Several possibilities will now be described in detail with two being alternate preferred embodiments and two being non-preferred. The rebound device 48' of FIGS. 5 and 6 comprises a rotating member 54 concentrically attached to a shaft 56 from the clutch 50. The rotating member 54 has a cylindrical body 58 having a pair of stiff torsion springs 60 wrapped therearound in opposite directions. The bottom end 62 of each torsion spring 60 is held firmly by a block 64 attached to a common base 66. The top end 68 of each torsion spring 60 bears against a peg 70 at the end of an arm 72 extending radially outward from the body 58 of the rotating member 54. As best seen from FIG. 5, as the shaft 56 rotates, it rotates the body 58 which, in turn, rotates the arm 72. As the arm 72 rotates, the top end 68 of the torsion spring 60 facing the peg 70 is rotated (i.e. minimally flexed) thereby.

Figure 7:
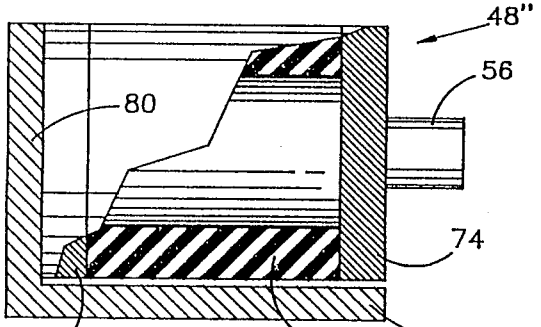
FIG. 7 is a partially cut away side view of the other of the two alternate preferred configurations for a rebounding device for use in the present invention.

The alternate preferred approach to the rebound device is shown in FIG. 7 where it is generally indicated as 48''. In this case, the shaft 56 is concentrically attached to a metal front disk 74. An elastomeric cylinder 76 is concentrically attached to the front disk 74 and a back disk 78 is concentrically attached to the other end of the cylinder 76. The back disk 78 is attached to a mounting plate 80. As those skilled in the art will readily recognize and appreciate, function of the back disk 78 could, of course, be incorporated into the mounting plate 80, if desired. In any event, the back end of the cylinder 76 is held against rotation by the back disk 78 (or some other means). When the shaft 56 is rotated, the front disk 74 is rotated therewith and attempts to twist the elastomeric cylinder 76 at the one end while the opposite end is being held against rotation. The result is a torsional force imparted into the material of the cylinder 76.

Figure 9:
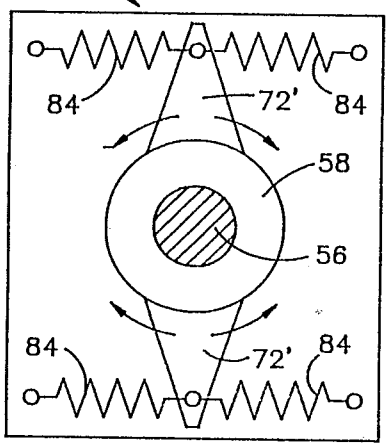
FIG. 9 is a simplified drawing of yet another non-preferred rebound device that can be employed in the present invention.
Figure 8:
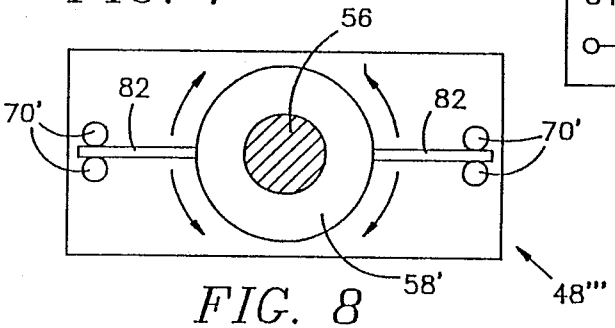
FIG. 8 is a simplified drawing of another, but not preferred, rebound device that can be employed in the present invention.

While not preferred, as shown in the rebound device 48''' of FIG. 8, a pair of torsion bars 82 radiating from a body portion 58' concentric about the shaft 56 and held between pegs 70' could be employed. Likewise, as shown in FIG. 9, a pair of arms 72' radiating from a body portion 58' concentric about the shaft 56 and having opposed pairs of springs 84 connected to the ends thereof could also be employed.

Figures 10, 11, 12:
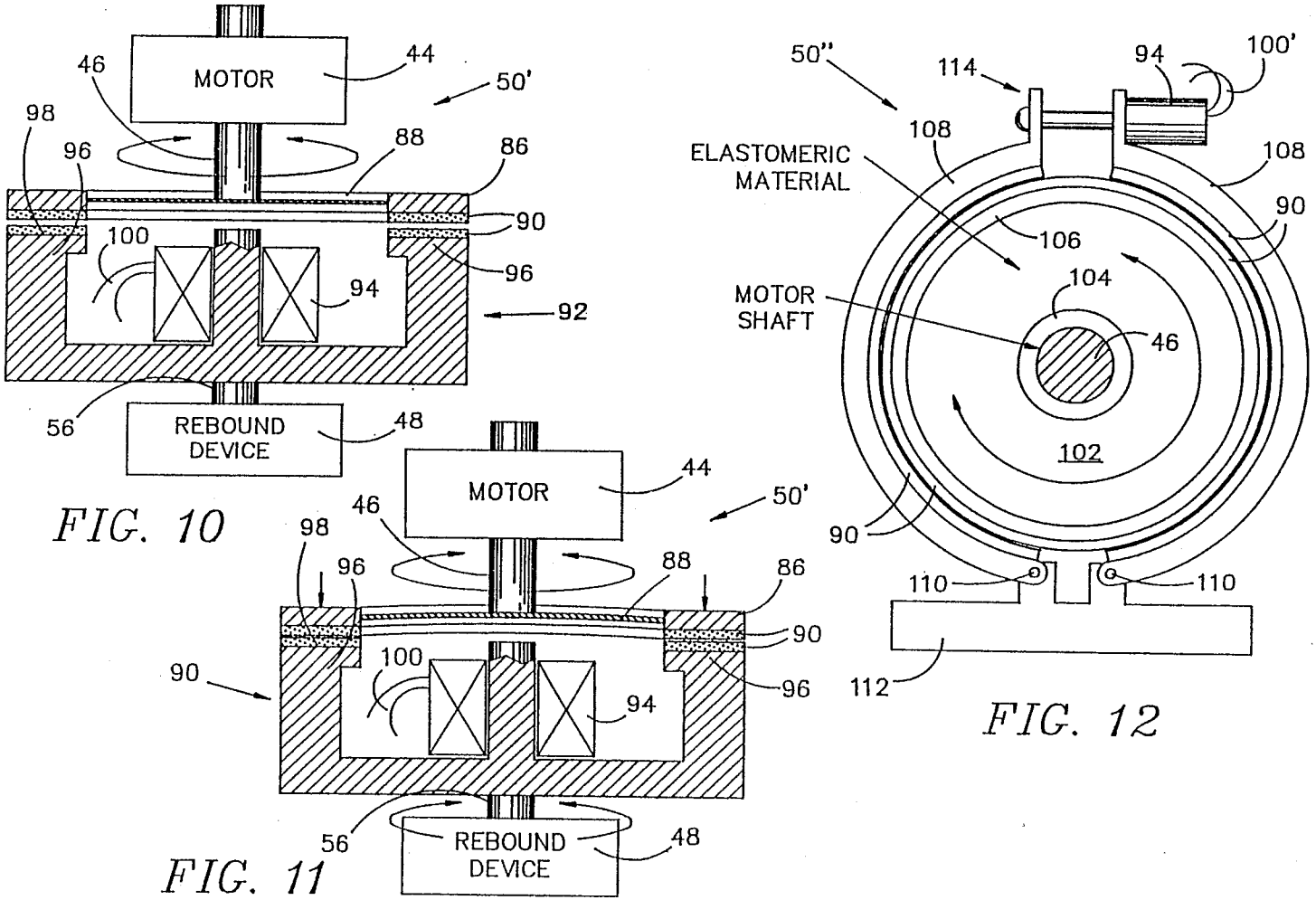
FIG. 10 is a simplified cut away drawing of an electromechanical clutch arrangement that is preferred w hen employing the rebound device of FIGS. 5 and 6, shown in its unlocked position.
FIG. 11 is a simplified cut away drawing of the electromechanical clutch arrangement of FIG. 10 showing it in its locked position.
FIG. 12 is a simplified front view drawing of an electromechanical clutch arrangement that is preferred when employing the rebound device of FIG. 7, shown in its unlocked position.

As depicted in FIGS. 10—12, the clutch 50 can also take several forms depending on the application and rebound device 48 employed. As those skilled in the art will readily appreciate, the order of the components (i.e. motor 44, clutch 50, and rebound device 48) can be alternated for functional equivalence while changing the rotational masses involved. For example, the clutch 50' of FIGS. 10 and 11 has a very small mass revolving with the motor 44. Thus, in applications where minimization of the revolving mass is important, the particular clutch in combination with the rebound device 48' of FIGS. 5 and 6 or the rebound device 48'' of FIG. 7 would be a good choice. In the clutch 50', a rotating ferro-magnetic ring 86 is concentrically mounted to the motor shaft 46 by a spring spider member 88. The ring 86 is faced on its outer surface with a frictional material 90. An electromagnet 92 is concentrically mounted to the shaft 56 connected to the rebound device 48. The electromagnet 92 has a coil 94 and pole pieces 96. The pole pieces 96 are disposed with faces 98 covered with frictional material 90 in close spaced facing relationship to the frictional material 90 on the ring 86 as depicted in FIG. 10. The clutch 50' is activated by applying a DC voltage to the coil 94 through wires 100. As depicted in FIG. 11, when the voltage is applied to the wires 100, the ring 86 is attracted to the pole pieces 96 by the electromagnetic force therein created by the coil 94. The frictional material 90 assures that the two facing surfaces do not slip. Thus, the rotational force of the ring 86 is virtually instantaneously connected into the electromagnet 92. The electromagnet 92, therefore, begins to rotate in combination with the ring 86 turning the shaft 56 connected thereto which, in turn, connects the rotating motion into the rebound device 48.

The clutch 50" of FIG. 12 employs a larger rotating mass but, because of its simplicity, is preferred in instances where the larger mass can be tolerated. As will be readily recognized from the description that follows, in this embodiment the rebound device is a variation of that described with respect to FIG. 7 and, additionally, is incorporated directly into a common structure with the clutch. In this embodiment, the motor shaft 46 has a concentric cylindrical mass of elastomeric material 102 disposed about it. The elastomeric material 102 can be conveniently formed by casting it between an inner ring 104 carried by the shaft 46 and an outer ring 106 concentrically disposed about the inner ring 104. The outer surface of the outer ring 106 is faced with frictional material 90. A pair of brake shoes 108 faced in their inner surfaces with frictional material 90 are disposed about the outer ring 106 in close spaced relationship thereto. One end of the brake shoes 108 is pivotally attached at 110 to a common mounting plate 112. The other end of the brake shoes 108 is attached to a solenoid actuator 114 by means of which the brake shoes 108 can be squeezed together around and grip the outer ring 106 by a DC voltage applied to the wires 100'. As can be appreciated, in this embodiment the elastomeric material 102 (of higher mass than the spider and ring of the previous embodiment) rotates with the motor shaft 46. When a DC voltage is applied to the wires 100,, the brake shoes 108 grip and hold the outer ring 106 as the shaft 46 and inner ring 104 continue to rotate. The result is a torsional twisting force into the elastomeric material 102 in the manner of the rebound device 48" of FIG. 7. As those skilled in the art will appreciate, the brake shoes 108 could be replaced with a single band brake disposed around the outer ring 108.

Figure 13:
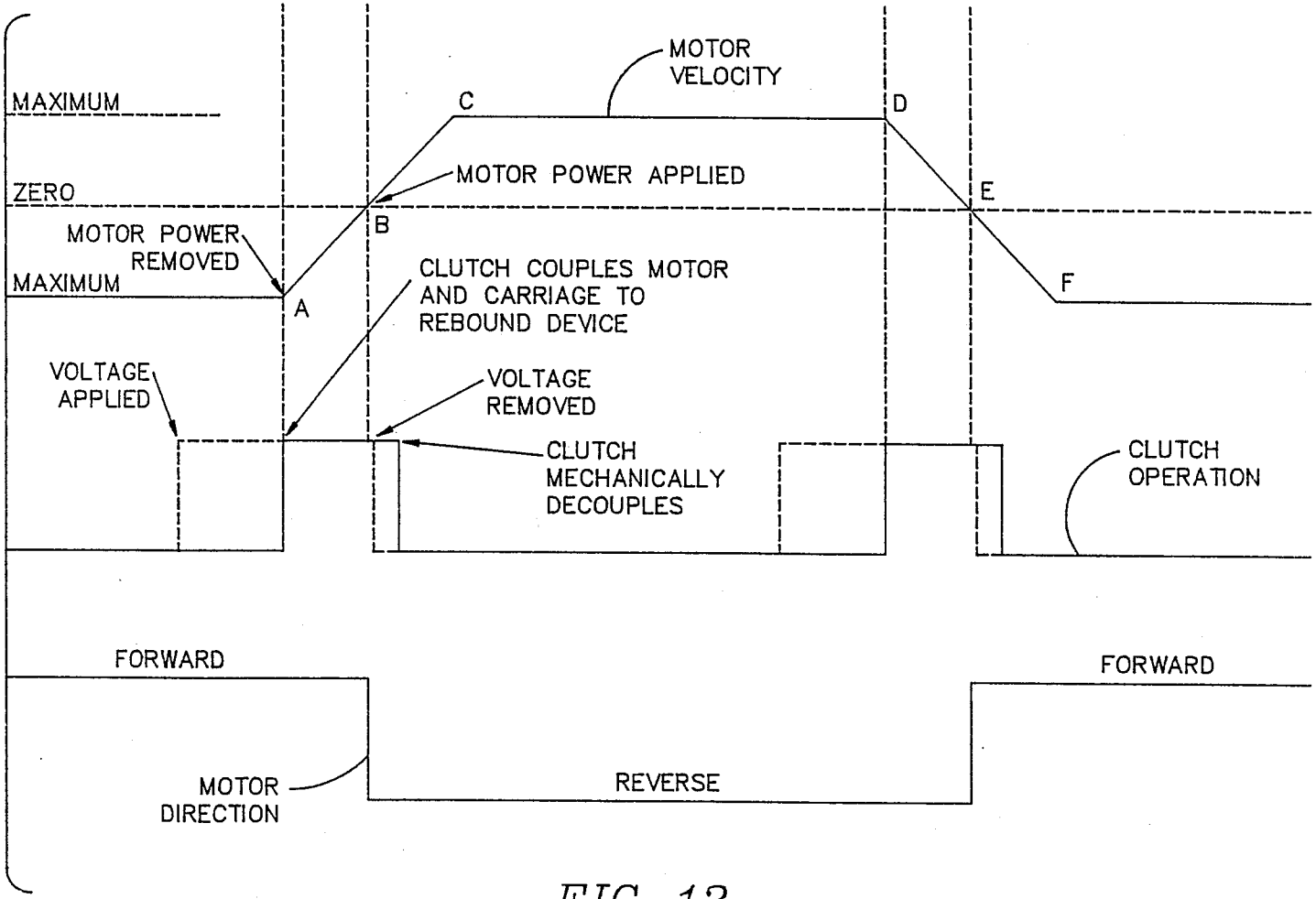
FIG. 13 is a timing chart showing the operation sequence employed in the present invention.

The motor 44 and rebound device 48 (through clutch 50) are operated by the logic 30, 32 in the manner shown in FIG. 13. With the motor 44 moving in a "forward" direction (where "forward" and "backward" are arbitrary directions) and assuming that reversal is to be affected at point "A", the DC voltage is applied to the clutch 50 prior to point A at a sensed distance such that clutch 50 will couple the motor 44 and carriage 12 to the rebound device 48 as the carriage 12 reaches point A. Simultaneously with the carriage 12 reaching point A and the clutch 50 coupling the motor 44 and carriage 12 to the rebound device 48, the driving power is removed from the motor 44. As can be seen, the coupled rebound device 48 then rapidly decelerates the carriage 12, absorbs it ballistic energy, and starts to retransmit it into the carriage 12 in the opposite direction. As the carriage 12 starts to move in the opposite direction, energy is reapplied to the motor 44 in that direction. As with the application of the rebound device 48 through the clutch 50 the release of the rebound device 48 takes some time; that is, by removing the DC voltage from the clutch 50, the rebound device 48 is not decoupled from the motor shaft 46 immediately. As those skilled in the art will appreciate, the release timing is more critical than the connect timing. What is desired is to retrieve the maximum stored ballistic energy from the rebound device 48 to assist in the acceleration of the carriage 12 in the opposite direction while preventing the rebound device 48 from passing "through center" and applying a breaking force in the opposite direction. Thus, as shown in the drawing of FIG. 13, the DC voltage is removed from the rebound device 48 at a time between points B and C such that the clutch 50 will decouple the rebound device 48 from the motor shaft 46 just prior to the rebound device 48 reaching its center or neutral point.

Wherefore, having thus described the present invention, what is claimed is:

1. A system, for a bi-directional motor drive which drives a member in an oscillatory motion between two end points, for increasing the speed of direction reversal of the member comprising:

(a) a selectively engageable ballistic rebound means for transferring energy of the moving member in one direction into a resilient member and for retransmitting energy absorbed by said resilient member back into the moving member in a direction opposite said one direction when engaged; and, (b) an electrically operated clutch for selectively engaging and disengaging said ballistic rebound means adjacent the end points to achieve the desired said energy transfers.

2. The system of claim 1 wherein said ballistic rebound means comprises:

(a) an input shaft mounted for bi-directional rotation; and, (b) torsion creating means connected to said input shaft for creating an opposing bias force opposite rotation of said input shaft.

3. The system of claim 2 wherein said torsion creating means comprises:

a pair of torsion springs mounted to resist rotation of said input shaft in respective ones of two opposite directions.

4. The system of claim 2 wherein said torsion creating means comprises:

an elastomeric member connected on a first end to said input shaft and held against rotation on a second end opposite said first end.

5. The system of claim 2 wherein:

(a) said torsion creating means comprises a cylindrical elastomeric member concentrically connected around said input shaft; and, (b) said electrically operated clutch comprises, (b1) brake means concentrically disposed about said cylindrical elastomeric member for selectively gripping said cylindrical elastomeric member to prevent rotation thereof, and (b2) brake activation means operatively connected for operating said brake means, said brake activation means including a coil disposed to compress said brake means about said elastomeric member whereby said elastomeric member is gripped and held against rotation when a voltage is applied to said coil.

6. The system of claim 1 wherein the motor drive includes a motor with a rotating shaft and:

(a) said electrically operated clutch is attached to the shaft of the motor; and, (b) said ballistic rebound means is connected to the shaft of the motor through said clutch.

7. The system of claim 6 wherein:

(a) said electrically operated clutch is concentrically attached to the shaft of the motor on an input side of said clutch; and, (b) said ballistic rebound means is connected to said clutch on an output side of said clutch.

8. The system of claim 7 wherein said electrically operated clutch includes:

(a) a ferro magnetic ring concentrically attached to the shaft of the motor through a spring spider; and, (b) an electromagnet concentrically connected to said ballistic rebound means, said electromagnet including a coil and pole pieces disposed adjacent said ring whereby said ring is attracted and gripped to couple said ring to said electromagnet when a voltage is applied to said coil.

9. The system of claim 1 wherein the motor drive includes a motor with a rotary shaft and:

(a) said ballistic rebound means is connected to the shaft of said motor; and, (b) said electrically operated clutch is an electrically operated brake connected to said shaft of said motor by way of said ballistic rebound means.

10. A method of operating a system for a bi-directional motor drive which drives a member in an oscillatory motion between two end points, for increasing the speed of direction reversal of the member, said system comprising:

a selectively engageable ballistic rebound means for transferring energy of the moving member in one direction into a resilient member and for retransmitting energy absorbed by said resilient member back into the moving member in a direction opposite said one direction when engaged; and, an electrically operated clutch for selectively engaging and disengaging said ballistic rebound means adjacent the end points to achieve the desired said energy transfers, comprising the steps of:

(a) sensing the position of the member with respect to the two ends;

(b) removing a drive voltage from the motor and connecting said ballistic rebound means to the motor drive at points with respect to the end points to cause the member to stop motion in one direction at a desired position with respect to the end points; and (c) applying a drive voltage to the motor and disconnecting said ballistic rebound means from the motor drive at points with respect to the end points to cause the member to stop and accelerate to a maximum velocity in a direction opposite said one direction.

11. A serial printer having a bi-directional motor drive which drives a carriage in an oscillatory motion between two end points, wherein to minimize the time for direction reversal of the carriage the printer comprise:

(a) selectively engageable ballistic rebound means for transferring energy of the moving carriage in one direction into a resilient member and for retransmitting energy absorbed by said resilient member back into the moving carriage in a direction opposite said one direction when engaged; and, (b) an electrically operated clutch for selectively engaging and disengaging said ballistic rebound means adjacent the end points to achieve the desired said energy transfers.

12. The system of claim 11 wherein the motor drive includes a motor with a rotary shaft and:

(a) said ballistic rebound means is connected to said shaft of said motor; and, (b) said electrically operated clutch is an electrically operated brake connected to said shaft of said motor by way of said ballistic rebound means.

13. The serial printer of claim 11 wherein said ballistic rebound means comprises:

(a) an input shaft mounted for bi-directional rotation; and, (b) torsion creating means connected to said input shaft for creating an opposing bias force opposite rotation of said input shaft.

14. The serial printer of claim 13 wherein said torsion creating means comprises:

a pair of torsion springs mounted to resist rotation of said input shaft in respective ones of two opposite directions.

15. The serial printer of claim 13 wherein said torsion creating means comprises:

an elastomeric member connected on a first end to said input shaft and held against rotation on a second end opposite said first end.

16. The serial printer of claim 13 wherein:

(a) said torsion creating means comprises a cylindrical elastomeric member concentrically connected around said input shaft; and, (b) said electrically operated clutch comprises, (b1) brake means concentrically disposed about said cylindrical elastomeric member for selectively gripping said cylindrical elastomeric member to prevent rotation thereof, and (b2) brake activation means operatively connected for operating said brake means, said brake activation means including a coil disposed to compress said brake means about said elastomeric member whereby said elastomeric member is gripped and held against rotation when a voltage is applied to said coil.

17. The serial printer of claim 11 wherein the motor drive includes a motor with a rotating shaft and:

(a) said electrically operated clutch is attached to the shaft of the motor; and, (b) said ballistic rebound means is connected to the shaft of the motor through said clutch.

18. The serial printer of claim 17 wherein:

(a) said electrically operated clutch is concentrically attached to the shaft of the motor on an input side of said clutch; and, (b) said ballistic rebound means is connected to said clutch on an output side of said clutch.

19. The serial printer of claim 18 wherein said electrically operated clutch includes:

(a) a ferromagnetic ring concentrically attached to the shaft of the motor through a spring spider; and, (b) an electromagnet concentrically connected to said ballistic rebound means, said electromagnet including a coil and pole pieces disposed adjacent said ring whereby said ring is attracted and gripped to couple said ring to said electromagnet when a voltage is applied to said coil.

20. A method of operating a serial printer having a bi-directional motor drive which drives a carriage in an oscillatory motion between two end points, wherein to minimize the time for direction reversal of the carriage the printer comprises:

selectively engageable ballistic rebound means for transferring energy of the moving carriage in one direction into a resilient member and for retransmitting energy absorbed by said resilient member back into the moving carriage in a direction opposite said one direction when engaged; and, an electrically operated clutch for selectively engaging and disengaging said ballistic rebound means adjacent the end points to achieve the desired said energy transfers, comprising the steps of:

(a) sensing the position of the carriage with respect to the two ends;

(b) removing a drive voltage from the motor and connecting said ballistic rebound means to the motor drive at points with respect to the end points to cause the carriage to stop motion in one direction at a desired position with respect to the end points; and (c) applying drive voltage to the motor and disconnecting said ballistic rebound means from the motor drive at points with respect to the end points to cause the carriage to stop and accelerate to a maximum velocity in a direction opposite said one direction.

21. In a serial printer wherein a bi-directionally operating motor with a shaft drives a carriage in an oscillatory motion between two end points, the method of operation for minimizing the time for direction reversal of the carriage comprising the steps of:

(a) connecting ballistic rebound means to transfer energy of the moving motor and carriage in one direction into a resilient member and retransmit energy absorbed by the resilient member back into the motor and carriage in a direction opposite the one direction;

(b) connecting an electrically operated clutch to selectively couple the ballistic rebound means to the shaft of the motor;

(c) sensing the position of the carriage with respect to the two ends; and, (d) removing a drive voltage from the motor and connecting the ballistic rebound means to the motor shaft at points with respect to the end points which will cause the carriage to stop motion in one direction at a desired position with respect to the end points and applying a drive voltage to the motor and disconnecting the ballistic rebound means from the motor shaft at points with respect to the end points which will cause the carriage to stop and accelerate to a maximum velocity in a direction opposite the one direction.

22. The method of claim 21 wherein the electrically operated clutch includes a ferromagnetic ring concentrically attached to the shaft of the motor through a spring spider and an electromagnet concentrically connected to the ballistic rebound means with the electromagnet including a coil and pole pieces disposed adjacent the ring and wherein said step of connecting the ballistic rebound means to the motor shaft comprises the step of:

applying a voltage to the coil whereby the ring is attracted and gripped to couple the ring to the electromagnet.

23. The method of claim 21 wherein the ballistic rebound means comprises a cylindrical elastomeric member concentrically connected around an input shaft concentrically connected to the motor shaft, the electrically operated clutch comprises brake means concentrically disposed about the cylindrical elastomeric member for selectively gripping the cylindrical elastomeric member to prevent rotation thereof and brake activation means operatively connected for operating the brake means including a coil disposed to compress the brake means about the elastomeric member, and wherein said step of connecting the ballistic rebound means to the motor shaft comprises the step of:

applying a voltage to the coil whereby the elastomeric member is gripped and held against rotation.

24. A ballistic energy recovery system for rotary output actuators arranged to provide an oscillatory motion between two end points a variable desired number of degrees of rotation apart comprising:

(a) a ballistic rebound means engageable, when desired, to transfer kinetic energy of said motion in one direction into stored potential energy and to transfer potential energy, so stored back into kinetic energy thereby to produce said motion in a direction opposite said one direction; and (b) an electrically operable clutch for engaging and disengaging said rebound means as required to produce said energy transfers and any desired number of degrees of rotation between said end points.

25. A ballistic energy recovery system according to claim 24 wherein said potential energy is stored in a resilient member.

26. A ballistic energy recovery system according to claim 24 wherein said electrically operable clutch couples said rotary output actuator to said ballistic rebound means.

27. A ballistic energy recovery system according to claim 24 wherein said ballistic rebound means is coupled to a said rotary output actuator and said electrically operated clutch is an electrically operable brake to apply a braking force to said ballistic rebound means when energy is to be stored thereby.

28. A ballistic energy recovery system according to claim 24 wherein said ballistic rebound means is bidirectional.

* * * * *